United States Patent [19]

Lyons et al.

[11] Patent Number: 4,530,274

[45] Date of Patent: Jul. 23, 1985

[54] PROCESS AND APPARATUS FOR FILTERING SPRAY COATING PARTICLES FROM AIR

[76] Inventors: Robert E. Lyons, 649 Highpoint Cir., Rochester, Mich. 48063; Arvid C. Walberg, 4443 St. Tropez Dr., Lisle, Ill. 60532

[21] Appl. No.: 371,412

[22] Filed: Apr. 23, 1982

Related U.S. Application Data

[63] Continuation of Ser. No. 129,688, Mar. 12, 1980, abandoned.

[51] Int. Cl.[3] ..... B05C 15/00

[52] U.S. Cl. ..... 98/115.2; 55/354; 55/528; 55/DIG. 46

[58] Field of Search ..... 55/352, 354, 528, DIG. 46; 98/115 R, 115 SB; 428/286, 296

[56] References Cited

U.S. PATENT DOCUMENTS

| | | | |
|---|---|---|---|
| 3,117,849 | 1/1964 | Selke | 55/354 X |
| 3,229,008 | 1/1966 | Harrington, Jr. et al. | 55/528 |
| 3,242,653 | 3/1966 | Sylvan | 55/354 |
| 3,417,552 | 12/1968 | Dyer et al. | 55/528 |
| 3,537,238 | 11/1970 | Dungler | 55/131 |
| 3,811,371 | 5/1974 | Hardy | 98/115 SB |
| 3,966,519 | 6/1976 | Mitchell et al. | 428/296 X |
| 3,968,283 | 7/1976 | Schutte | 428/296 X |
| 4,022,596 | 5/1977 | Pedersen | 210/499 |
| 4,229,187 | 10/1980 | Stockford et al. | 55/528 X |

FOREIGN PATENT DOCUMENTS

| | | | |
|---|---|---|---|
| 595002 | 3/1934 | Fed. Rep. of Germany | 98/115 SB |

*Primary Examiner*—Harold Joyce
*Attorney, Agent, or Firm*—Thomas A. Stansbury

[57] ABSTRACT

A spray booth has a front movable wall composed of two layers of movable, flexible filter material supplied from a single continuous supply roll located adjacent the floor of the booth. The layers of filter material are composed of a mat of closely-spaced non-woven extruded polypropylene fibers forming a multiplicity of cells and randomly positioned non-woven polypropylene fibers extending from the mat into each said cell to provide sub-cells of sub-micron size openings.

5 Claims, 6 Drawing Figures

PROCESS AND APPARATUS FOR FILTERING SPRAY COATING PARTICLES FROM AIR

This application is a continuation of application Ser. No. 129,688, filed Mar. 12, 1980, now abandoned.

BACKGROUND OF THE INVENTION

I. Field of the Invention

The present invention relates to spray coating booths for trapping and collecting air-borne coating overspray which has been discharged from a coating spray gun or other application device and more particularly to spray coating booths having a movable wall of filter material.

II. Description of the Prior Art

There are three types of spray booths available and used throughout this industry.

Type No. 1: The most universally used type is the water-wash spray booth. The water-wash type spray booth is generally considered to be the most efficient spray booth available but the efficiency ratings are directly related to the operating conditions, maintenance and a variety of other factors. A properly operated, clean, water-wash spray booth is rated anywhere from 80% to 92% efficient in collecting and trapping, with water, air-borne paint particles. The collection is accomplished using a variety of "water curtains" and "eliminator" (baffle) plates over which the paint particles are drawn by use of an exhaust fan. The paint particles collected are trapped in a water pan (tank), chemically treated to form a sludge, and then periodically removed for disposal.

The major disadvantages of water-wash paint spray booths are:

1. Approximately 8 to 20 percent of the air-borne paint over-spray is exhausted from the booth to the atmosphere.
2. Restrictions in disposing of collected overspray (sludge).
3. High cost of proper booth maintenance.
4. Restrictions in obtaining desired uniform air flow required for ideal spraying conditions.
5. Large quantities of water are recirculated (approximately 30 GPM per lineal foot of booth).
6. Large volume of air necessary to perform collection action required.
7. Fire hazard due to presence of paint residue on both 'eliminator' plates, plenum walls, fan blades and exhaust stack.

Type No. 2: The dry filter type paint spray booth is commonly used throughout industry for touch-up spraying, batch operations and in increasing number, as production spray booths. The filter type booth employs a paint arrestor pad (filter) which is constructed of fiberglass or other materials, (similar to a furnace filter). Filters are normally 20"×20"×1" in size and are arranged to form the front wall of an exhaust plenum which includes an exhaust fan designed to draw air-borne paint particles into the filter media. Generally filter booths of this type are rated 70% efficient, in that at least 30% of the air-borne paint particles are drawn through the filter pads and are discharged out the exhaust fan and stack to the atmosphere.

The main disadvantages of the dry filter type paint spray booth are:

1. Low efficiency in collecting air-borne paint particles.
2. High cost in replacing filters. (usually daily).
3. Restrictions in disposing of paint-soaked filter pads.

4. Large quantity of exhaust air required.
5. High level of fire hazard.
6. Large volume of exhausted air-borne paint particles depositing on property surrounding paint operation.

Type No. 3: The third type of booth is generally referred to as a "roll-filter" spray booth. The roll filter booth is very limited (less than 1%) in use in this industry. The only roll-type filter booth available is referred to in U.S. Pat. Nos. 2,875,680; 2,841,073; 3,071,060; and 3,811,371. This roll-filter paint spray booth is designed using a 60" wide, 400 ft. long roll of non-woven cotton shoddy fabric which is positioned on top of the booth enclosure, drawn downward to form the front wall (single curtain) of an exhaust plenum. The exhaust plenum is equipped with an exhaust fan which is designed to draw the air-borne paint overspray into the 'filter curtain' thus entrapping particles. As the filter curtain becomes saturated with paint articles the curtain indexes by use of a drive on the wind-up shaft, exposing fresh filter.

Under certain conditions this booth can be 100% efficient in collecting and trapping air-borne paint particles. However, design limitations and inconsistent quality of filter material normally allows a much lower efficiency factor in its ability to consistently trap air-borne paint particles.

The major disadvantages of the roll-type filter paint spray booth are:

1. Limitations in width and height of booth sections.
2. Inconsistent quality of filter material (tears).
3. 10% to 20% filter waste.
4. Relative high labor cost to load and unload filter media.

Based on our investigations we concluded that there is a definite need by the finishing industry for a paint spray booth designed, not only to fulfill the industry needs but also to accommodate current and anticipated E.P.A., OSHA, and Insurance requirements.

SUMMARY OF THE INVENTION

The present invention is designed to utilize a roll of polypropylene fabric (micro-filter) in a spray booth designed to not only attract but trap 100% of air-borne paint particles (overspray) discharged from paint application devices.

It is therefore an object of the present invention to provide a new and improved method of trapping and collecting air-borne paint overspray.

Another object is to provide a paint spray booth which will require less exhaust air.

An additional object is to provide a coating spray booth which will require less maintenance than those presently available.

Yet another object is to provide a spray coating booth of relative unlimited size.

Still another object is to provide a movable filter material which is stronger and therefore subject to less tearing than those previously available.

A still further object is to provide new and improved apparatus for performing the aforestated process.

DESCRIPTION OF THE DRAWINGS

Further objects and advantages will become apparent from the following detailed description taken in conjunction with the accompanying drawings in which.

DESCRIPTION OF THE PREFERRED EMBODIMENT

Figure 1:
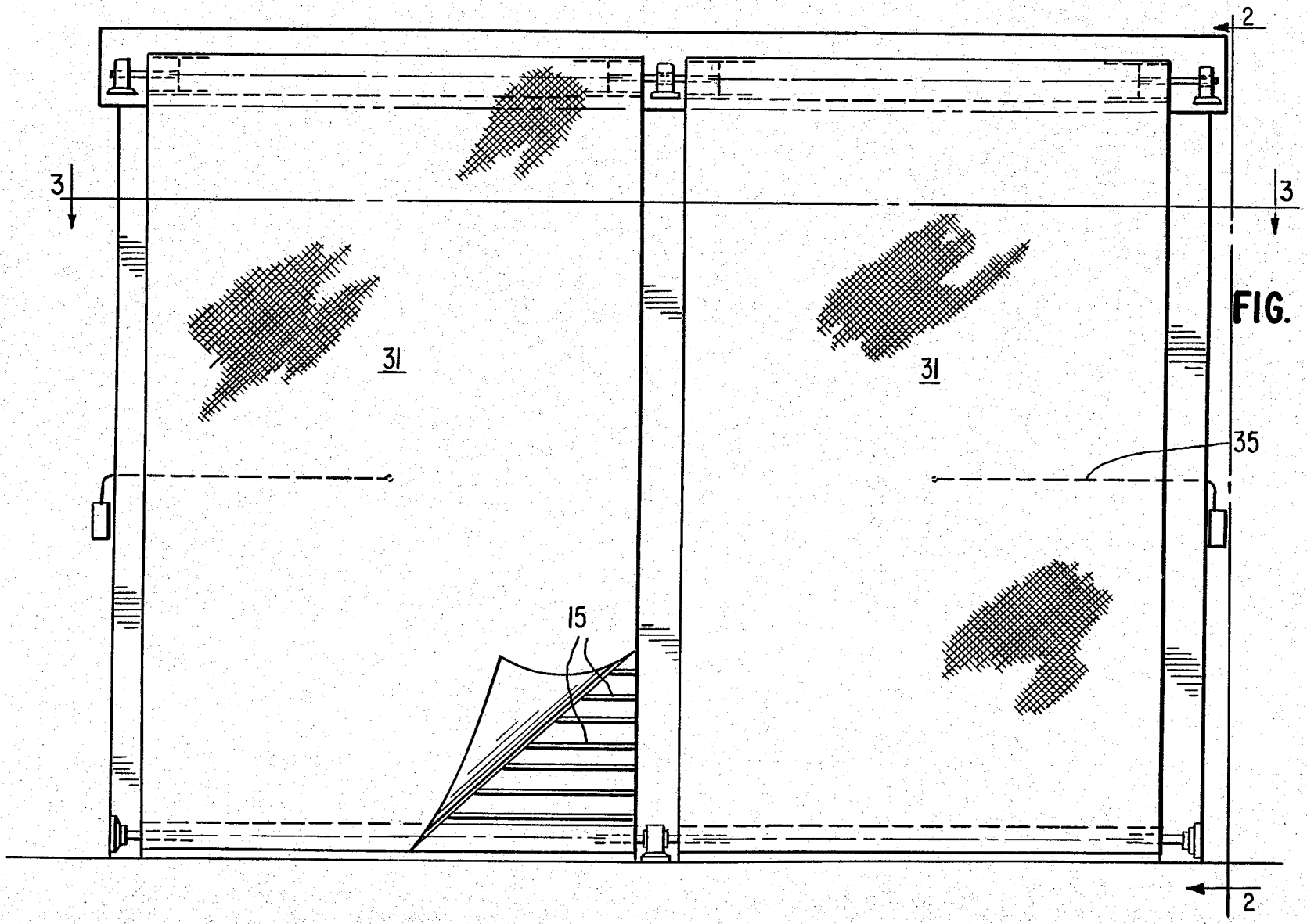
FIG. 1 is an elevation drawing of a preferred embodiment of the invention.
Figure 2:
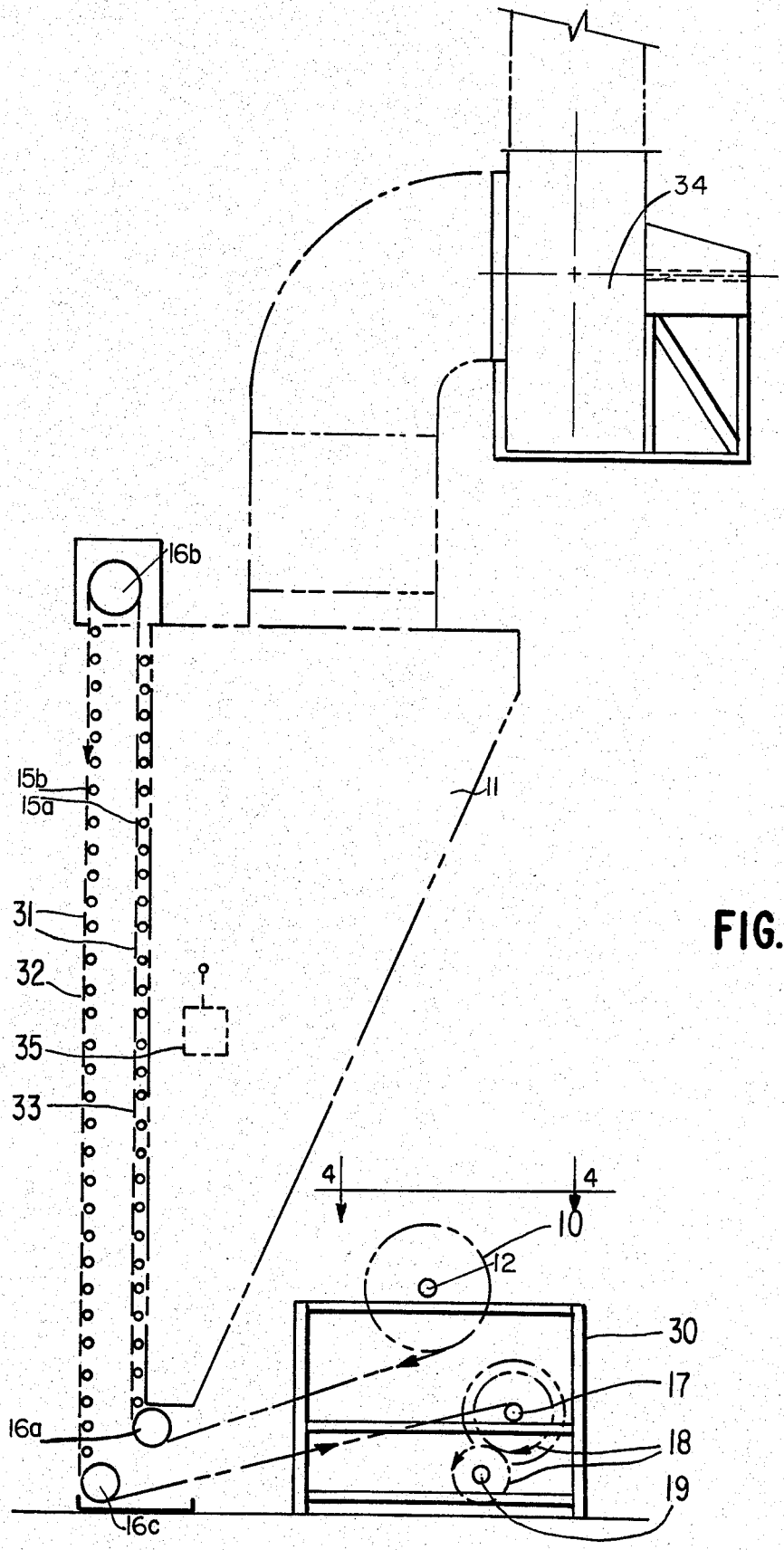
FIG. 2 is an elevational drawing of one end of the preferred embodiment illustrated in FIG. 1, taken along the line 2—2 in FIG. 1.
Figure 3:
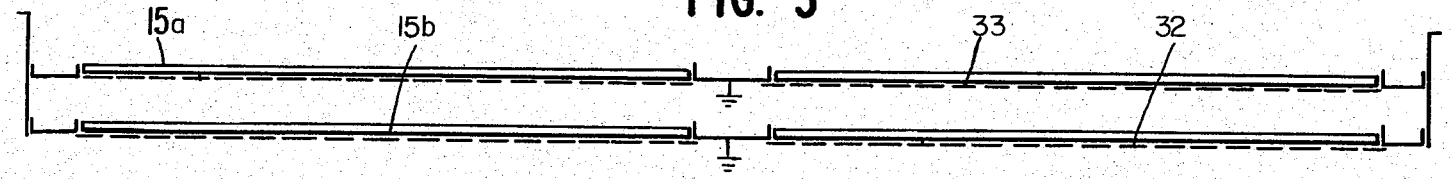
FIG. 3 is a cross-sectional drawing of the invention illustrated in FIG. 1, taken along the lines 3—3 in FIG. 1.
Figure 4:
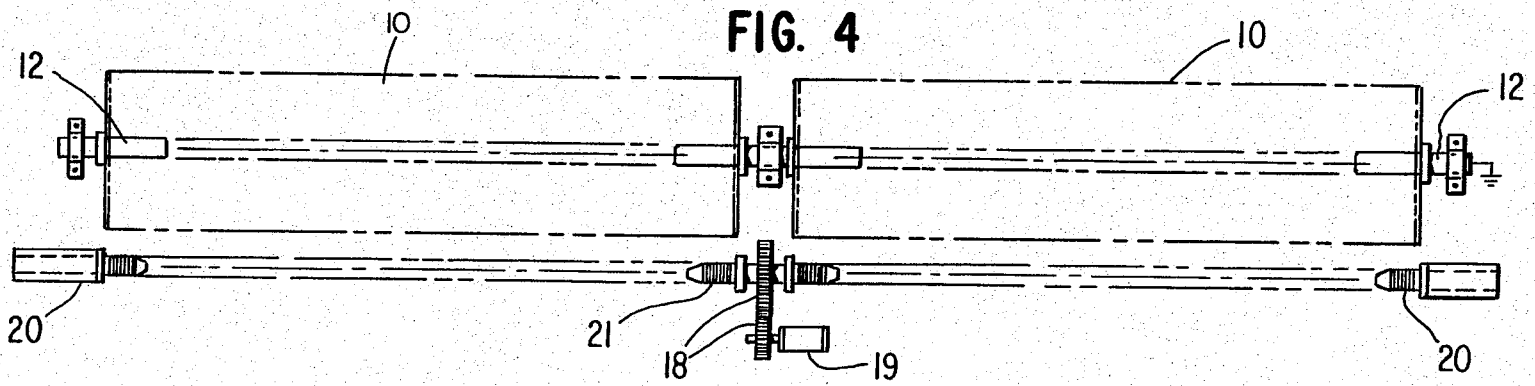
FIG. 4 is a cross-sectional drawing taken along the line 4—4 in FIG. 2.

While this invention is susceptible of embodiment in many different forms, there will be described herein—in detail—embodiment of the invention with the understanding that the present disclosures are to be considered as the simplifications of the principals of the invention and are not intended to limit the invention to the embodiments illustrated. The scope of the invention will be pointed out in the appended claims.

Referring to the embodiment of the invention illustrated in FIGS. 1-4, 600-yard rolls 10 of fabric are loaded behind spray booth plenum 11 on "pay-out" shafts 12. The filter material is drawn around "Idler" rollers 16*a*, upwards through exhaust plenum 11 in front of back-up rollers 15*a*, around "idler" rollers 16*a*, downward in front of back-up rollers 15*b*, and around "idler" rollers. The end of the filter rolls are affixed to the cardboard "wind-up" tubes 17 which are rotated with a set of gears 18 driven by an air motor 19. The "wind-up" tubes 17 are rotated by use of air-chucks 20 and 21 which are expanded during operation and then collapsed when "wind-up" tubes 17 have accumulated approximately 300 yards of used filter.

The "pay-out" shafts 12, "wind-up" tubes 17, air-chucks 20 and 21, drive gears 18 and air drive motor 19 are all mounted on a structural steel frame 30. A filter curtain generally indicated at 31 forms a double layer of fabric 32 and 33 which becomes the face or front wall of the sheet metal exhaust plenum. An exhaust fan 34, designed not to exceed 80 decibels, provides necessary air velocity and volume to draw air-borne particles into curtain 31.

A manometer 35 positioned behind the curtain in plenum is adjusted to detect reduced air flow through filter media, due to paint accumulation, and energize a solenoid valve (not shown) which will provide compressed air to the air (drive) motor 19 thus indexing gears 18 to wind up used filter and provide clean filter material.

The rollers 16*a*, *b*, and *c* and back-up rollers 15*a* and *b* are electrically conductive and grounded to further attract electrically charged air-borne paint particles on an electrostatic spray coating system.

Figure 6:
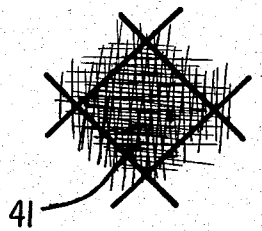
FIG. 6 is a magnified cell of the cell illustrated in FIG. 5.
Figure 5:
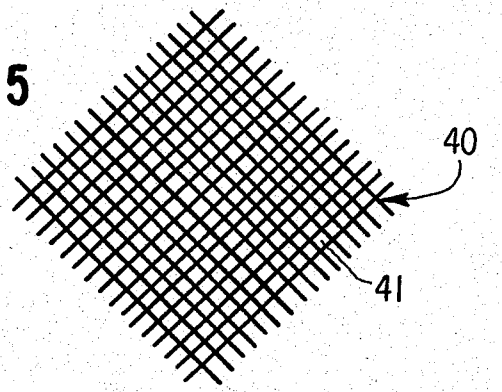
FIG. 5 is a 1.75 enlarged drawing of a square inch elevational section of the filter material utilized in the preferred embodiment of the invention.

Referring now to FIGS. 5 and 6, the double layer filter curtain or wall 31 is constructed of non-woven extruded polypropylene fibers formed as a mat or grid 40 and then bonded together with heat and pressure. The construction of the mat provides approximately 225 cells per square inch, as illustrated in FIG. 5. FIG. 5 is 1.75×actual size of mat. Thus each cell in the mat, such as cell 41, has the fibers forming the cell spaced approximately 40 microns apart.

Referring now to FIG. 6 specifically, the typical "40 micron size" cell 41 is magnified to more clearly show a multiplicity of polypropylene fibers extending from the mat into the cell 41 to form a great multiplicity of random sub-cells of sub-micron size.

The majority of air-borne paint particles are in the range of 5 to 200 microns in size and are entrapped on the polypropylene fibers. The sub-micron cell openings continue to allow air flow through the fabric.

The formation of the polypropylene fabric curtain on to which air-borne paint overspray is directed permits complete filtration of paint particles yet allows continuous clean air flow through the curtain, discharging through an air plenum stack and then to the atmosphere.

The filter wall may be of various thicknesses. For most coating sprays 1.1 ounce per yard filter fabric has been found to be adequate. The exhaust fan 34 draws air through the curtain or wall 31 thus allowing layer 32 to filter out all or substantially all of the coating overspray. Some overspray may penetrate layer 32 and whenever this occurs it is caught on layer 33, thus assuring substantially 100% filtration of overspray. If the sprayguns or apparatus are operated without work being in front of the curtain or wall 31, or if pure solvent is used to flush the spray system, it may soak through the first layer of 1.1 ounce per-square-yard weight fabric. Under such conditions 1.5 ounce per-square-yard or 2.0 ounce per-square-yard material may be utilized to prevent solvent from soaking through the first layer 32.

Those skilled in the art will recognize that other types of filter fabric may be substituted in the coating spray booth set forth in the preferred embodiment of this invention with somewhat reduced efficiency. However, the utilization of other filter fabrics familiar in the art will be more efficient with the use of the double layer wall of this invention. Those skilled in the art will also recognize that the filter fabric described herein may be utilized on prior art moving wall spray booths to increase efficiency. In such circumstances, 1.5 to 3.0 ounce per-square-yard weight fabric may be utilized.

We claim:

1. A spray booth having a first movable wall, consisting of a continuous layer of flexible filter material, wherein the improvement comprises:

(a) a supply roll of the continuously flexible layer of filter material rotatably mounted adjacent the lower end of said first movable wall, (b) grids of back-up rollers, which are electrically conductive and electrically grounded, for directing and supporting said continuous layer of flexible filter material from said supply roll upward to form a second movable wall paralleling said first movable wall and having an upper end, (c) grids of back-up rollers, which are electrically conductive and electrically grounded, for directing and supporting said continuous layer of flexible filter material from the upper end of said movable wall downward to form said first movable wall having a lower end, (d) disposable means for rolling up said continuous layer of flexible filter material mounted adjacent to the lower end of said first movable wall, and (e) means for directing an air flow containing atomized coating material sequentially through said first and second movable walls, said coating material being composed of solid coating particles and liquid solvent.

2. A spray booth as specified in claim 1, wherein the layer of flexible filter material comprises:

(a) a flexible mat of closely spaced fibers forming a multiplicity of cells, and (b) a multiplicity of randomly positioned fibers extending from the mat into each said cell to fill each said cell with a multiplicity of random sub-cells.

3. A spray booth as specified in claim 1, wherein the layer of flexible filter material comprises:

(a) a flexible mat of closely spaced non-woven extruded polypropylene fibers forming a multiplicity of approximately square cells, and (b) a multiplicity of randomly positioned non-woven polypropylene fibers extending from the mat into each said cell to fill each said cell with a multiplicity of random sub-cells of sub-micron size openings.

4. A spray booth having movable wall, consisting of a continuous layer of flexible filter material, wherein the improvement comprises:

(a) constructing said layer of a flexible mat of closely spaced non-woven extruded polypropylene fibers formeing a multiplicity of approximately square cells, (b) a multiplicity of randomly positioned non-woven polypropylene fibers extending from the mat into each said cell to fill each said cell with a multiplicity of random sub-cells of submicron-size openings, and (c) grids of back-up members, which are electrically conductive and electrically grounded, for directing and supporting said continuous layer of flexible filter material.

5. A filter material as specified in claim 4, wherein:

(a) said mat consists of approximately 225 cells per-square, and (b) said material weighs between 1.0 and 3.0 ounces per-square-yard.

* * * * *